US007858281B2

(12) United States Patent
Veregin et al.

(10) Patent No.: US 7,858,281 B2
(45) Date of Patent: Dec. 28, 2010

(54) ACID-BASE PROPERTY CONSIDERATIONS FOR IMPROVED ADDITIVE ATTACHMENT ON TONER

(75) Inventors: Richard P. N. Veregin, Mississauga (CA); Maria N. V. McDougall, Oakville (CA)

(73) Assignee: Xerox Corporation, Norwalk, CT (US)

( * ) Notice: Subject to any disclaimer, the term of this patent is extended or adjusted under 35 U.S.C. 154(b) by 473 days.

(21) Appl. No.: 11/943,683

(22) Filed: Nov. 21, 2007

(65) Prior Publication Data

US 2009/0130588 A1 May 21, 2009

(51) Int. Cl.
*G03G 9/00* (2006.01)

(52) U.S. Cl. ..... 430/108.1; 430/108.3; 430/108.6; 430/137.21

(58) Field of Classification Search ..... 430/108.1, 430/108.3, 108.6, 137.21
See application file for complete search history.

(56) References Cited

U.S. PATENT DOCUMENTS

| | | | | |
|---|---|---|---|---|
| 5,556,727 | A | 9/1996 | Ciccarelli et al. | |
| 2006/0269858 | A1 * | 11/2006 | McDougall et al. ..... | 430/106.1 |
| 2008/0171279 | A1 * | 7/2008 | Veregin et al. ..... | 430/109.3 |

OTHER PUBLICATIONS

U.S. Appl. No. 11/624,004, filed Jan. 17, 2007 by Veregin et al.

* cited by examiner

*Primary Examiner*—Mark A Chapman
(74) *Attorney, Agent, or Firm*—Oliff & Berridge, PLC

(57) ABSTRACT

A developer comprised of a toner and at least one external surface additive, wherein an acid-base interaction has an Interaction Surface Parameter ($I_{SP}$) of greater than 0, and wherein $I_{SP}$ is defined by the following equation: $[(K_a)_{toner}\times(K_b)_{additive}]+[(K_b)_{toner}\times(K_a)_{additive}]-[(K_a)_{toner}\times(K_a)_{additive}]-[(K_b)_{toner}\times(K_b)_{additive}]$, wherein $K_a$ is the Lewis acid value and $K_b$ is the Lewis base value.

21 Claims, No Drawings

ACID-BASE PROPERTY CONSIDERATIONS FOR IMPROVED ADDITIVE ATTACHMENT ON TONER

BACKGROUND

The present disclosure is related to methods of predicting acid-base pair interaction in xerographic developer materials. In particular, the acid-base pair interaction of xerographic developer materials is established by calculating an Interaction Surface Parameter ($I_{SP}$). Using the $I_{SP}$ calculated parameter, suitable toner particles and surface additive particles may be selected that achieve strong adhesion with each other.

Effectively attaching surface additives to a toner particle surface is critical to high image quality and long component life. Loose toner surface additives can end up falling off of the toner surface and onto a photoreceptor, initiating ghosting or causing toner build up on the photoreceptor that results in cleaning failure with blade cleaners and giving rise to toner streaks on prints. Loose surface additives that fall off of toner may also transfer to a carrier, resulting in loss of toner charge and requiring an increased carrier replenisher ratio, which adds cost. In addition, loose surface additives that fall off of toner can also end up on the bias charging roll (BCR) in products that use a BCR, which can result in streaks on the prints. Poor additive attachment can become even more problematic as the surface additives become larger, and particularly with spacer particles >100 nm in size.

Currently, approaches that deal with this issue: 1) strongly imbed or impact the additives into the toner surface, which is also observed when toner ages in a development housing; however, this may be associated with performance in developer flow, charging, cleaning and/or transfer; 2) increase blend time or blend power; or 3) keep surface additive size small, for example less than about 100 nm in size. However, both the use of small additive size and strong additive embedding are opposite to a desire for larger additives for reduced impaction and to reduce the amount of impaction of the additives. Further, increased blend power increases energy consumption it, toner making and increasing blend time degrades cycle time and increases energy consumption.

What is still desired is an improved method to obtain greater adhesion of surface additive particles to toner particles.

SUMMARY

In embodiments, describes is a developer comprised of a toner and at least one external surface additive, wherein an acid-base interaction has an Interaction Surface Parameter ($I_{SP}$) of greater than 0, and wherein $I_{SP}$ is defined by the following equation: $[(K_a)_{toner}\times(K_b)_{additive}]+[(K_b)_{toner}\times(K_a)_{additive}]-[(K_a)_{toner}\times(K_a)_{additive}]-[(K_b)_{toner}\times(K_b)_{additive}]$, wherein $K_a$ is the Lewis acid value and $K_b$ is the Lewis base value.

In further embodiments, described is a method of obtaining acceptable acid-base interaction between a toner and at least one external surface additive of the toner including selecting a candidate toner, selecting a candidate external surface additive, determining the Lewis acid and Lewis base constants for the candidate toner and the candidate external surface additive, calculating an Interaction Surface Parameter ($I_{SP}$), and wherein the Interaction Surface Parameter ($I_{SP}$) of greater than 0 is predictive of acceptable acid-base interaction, and wherein $I_{SP}$ is defined by the following equation: $[(K_a)_{toner}\times(K_b)_{additive}]+[(K_b)_{toner}\times(K_a)_{additive}]-[(K_a)_{toner}\times(K_a)_{additive}]-[(K_b)_{toner}\times(K_b)_{additive}]$.

In still further embodiments, described is a method of making a developer composed of at least a toner and at least one external surface additive including determining a Lewis acid constant for the toner, a Lewis base constant for the toner, a Lewis acid constant for the at least one external surface additive, and a Lewis base constant for the at least one external surface additive, calculating the Interaction Surface Parameter ($I_{SP}$) by applying the following equation: $[(K_a)_{toner}\times(K_b)_{additive}]+[(K_b)_{toner}\times(K_a)_{additive}]-[(K_a)_{toner}\times(K_a)_{additive}]-[(K_b)_{toner}\times(K_b)_{additive}]$, and when the $I_{SP}$ is greater than 0, combining the toner and the at least one external surface additive.

EMBODIMENTS

The present disclosure relates to a process for obtaining a value relating to the acid-base pair interaction parameter between a toner particle and an additive, and making the toner particle having that additive thereon when the value satisfies predetermined conditions.

Generally, the process of electrophotographic printing includes charging a photoconductive member to a substantially uniform potential to sensitize the surface thereof. The charged portion of the photoconductive surface is exposed to a light image from a scanning laser beam, an LED source, or an original document being reproduced. This records an electrostatic latent image on the photoconductive surface. After the electrostatic latent image is recorded on the photoconductive surface, the latent image is developed. Two-component developer materials are commonly used for development. A typical two-component developer comprises carrier granules such as magnetic carrier granules, having toner particles tribo-electrically charged and adhering thereto. The toner particles are attracted to the latent image, forming a toner powder image on the photoconductive surface. The toner powder image is subsequently transferred to a copy sheet. Finally, the toner powder image is heated and/or pressed to permanently fuse it to the copy sheet in image configuration.

In electrophotographic imaging, developer compositions may comprise one or more toner compositions alone (single component developer) or together with one or more carrier compositions (two component developers). Developers incorporating carriers may be generated by mixing the carrier particles with toner particles, for example having a composition comprised of resin binder and colorant. Generally, from about 1 part to about 5 parts by weight of toner particles are mixed with from about 10 parts to about 300 parts by weight of the carrier particles. The toner concentration in the developer initially installed in a xerographic development housing may be from about 1 to about 25, such as from about 3 to about 10, parts of toner per one hundred parts of carrier.

The toners and developers disclosed herein may be used in xerographic devices that have a variety of process speeds. For example, such devices may have process speeds from about 170 mm/sec to about 500 mm/sec, such as from about 180 mm/sec to about 390 mm/sec or from about 190 mm/sec to about 380 mm/sec. The print speed of the xerographic devices may be from about 20 ppm to about 300 ppm, such as from about 25 ppm to about 100 ppm or from about 30 ppm to about 90 ppm. In embodiments, the print speed may be about 35 ppm, about 38 ppm, about 45 ppm, about 55 ppm, about 75 ppm or about 87 ppm.

Illustrative examples of carrier particles that may be selected for mixing with the toner particles include those particles that are capable of tribo-electrically obtaining a charge of opposite polarity to that of the toner particles. Illustrative examples of suitable carrier particles include granular zircon, granular silicon, glass, steel, nickel, ferrites, iron ferrites, silicon dioxide, and the like. Additionally, there can be selected as carrier particles, for example, nickel berry carriers comprised of nodular carrier beads of nickel, characterized by surfaces of reoccurring recesses and protrusions thereby providing particles with a relatively large external area.

In embodiments, the carrier is comprised of atomized steel available commercially from, for example, Hoeganaes Corporation. The carrier core may also be comprised of ferrite particles. Any commercially available ferrite carrier may be used. The carrier core may be comprised of a manganese magnesium ferrite core, which is commercially available from Powdertech. The ferrite particles used as carrier cores in the developer composition may have an average particle size (diameter) of, for example, about 10 μm to about 100 μm, or about 20 μm to about 70 μm, such as 25 μm to about 40 μm, as determined by standard laser diffraction techniques.

The selected carrier particles can be used with or without a coating, the coating generally being comprised of fluoropolymers, such as polyvinylidene fluoride resins, terpolymers of styrene, methyl methacrylate, a silane, such as triethoxy silane, tetrafluorethylenes, and other known coatings and the like.

In further embodiments, the carrier core may be fully or partially coated with a polymethyl methacrylate (PMMA) polymer having a weight average molecular weight of 300,000 to 350,000 commercially available from, for example, Soken. The PMMA is an electropositive polymer in that the polymer will generally impart a negative charge on the toner with which it is contacted. PMMA may be made by an emulsion polymerization process and may also have a narrow particle size distribution with polymer particles in the about 100 nm to about 200 nm size range, or about 125 nm to about 175 nm, such as about 140 nm to about 160 nm. This small size is desirable to provide uniform coverage on the small ferrite core.

The PMMA may optionally be copolymerized with any desired comonomer, so long as the resulting copolymer retains a suitable particle size. Suitable comonomers may include monoalkyl, or dialkyl amines, such as a di methylaminoethyl methacrylate, diethylaminoethyl methacrylate, diisopropylaminoethyl methacrylate, or t-butylaminoethyl methacrylate, and the like. If the PMMA polymer has carbon black dispersed therein and may be formed in a semisuspension polymerization process.

As mentioned above, the polymer coating of the carrier core may be comprised of PMMA, such as PMMA. PMMA may be applied in dry powder form and having an average particle size of less than 1 micrometer, such as less than 0.5 micrometers, which is applied (melted and fused) to the carrier core at higher temperatures on the order of 220° C. to 260° C. Temperatures above 260° C. may adversely degrade the PMMA. Tribo-electric tunability of the carrier and developers herein is provided by the temperature at which the carrier coating is applied, higher temperatures resulting in higher tribo up to a point beyond which increasing temperature acts to degrade the polymer coating and thus lower tribo.

In embodiments, the carrier particles may be coated with a mixture of at least two dry polymer components, for example, dry polymer components not in close proximity thereto in the triboelectric series, and of opposite charging polarities with respect to the toner selected. The electronegative polymer, that is, the polymer that will generally impart a positive charge on the toner with which it is contacted, may be comprised of a polyvinylidenefluoride polymer or copolymer. Such polyvinylidenefluoride polymers are commercially available, for example, from KYNAR™. The electropositive polymer, that is, the polymer that will generally impart a negative charge on the toner with which it is contacted may be comprised of a poly mer or copolymer of polymethyl methacrylate (PMMA), optionally having carbon black or another conductive material dispersed therein. PMMA by itself is an insulative polymer.

In embodiments, to obtain a conductive carrier coating, a conductive component, for example, carbon black, is dry blended with the PMMA and any other carrier coating constituents. The mixture is then tumbled onto the core and fused.

In embodiments, the carrier may be coated by dissolving the polymer resin, and optional ingredients to increase conductivity, in a solvent, followed by drying to remove residual solvent.

Toner compositions that may be used in accordance with embodiments herein are not particularly limited and should be readily understood by those of skill in the art. The toner compositions typically comprise at least resin binder and colorant. Illustrative examples of suitable loner resins for use in embodiments include polyamides, epoxies, polyurethanes, diolefins, vinyl resins, styrenes, styrene acrylates, styrene methacrylates, styrene butadienes, polyesters such as the polymeric esterification products of a dicarboxylic acid and a diol, and the like.

In embodiments, at least one binder is desired. Although any type of toner binder resin may be used, such as polyacrylates and polyesters, other resins, including copolymers of polystyrene and polybutylacrylate, may also be applicable. The binder resins may be suitably used in an emulsion aggregation process to form toner particles of the desired size.

Illustrative examples of resins include polymers selected from poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid, polystyrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate isoprene), poly(ethyl acrylate-isoprene), poly(propyl acrylate-isoprene), and poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylononitrile-acrylic acid), poly(para-methyl styrene-butadiene), poly(meta-methyl styrene-butadiene), poly(alpha-methyl styrene-butadiene), poly(para-methyl styrene-isoprene), poly(meta-methyl styrene-isoprene), poly(alpha-methyl styrene-isoprene), poly(methylacrylate-styrene), poly(ethylacrylate-styrene), poly(methyl methacrylate-styrene), combinations thereof and the like.

Further illustrative examples of resins include polyethylene-terephthalate, polypropylene-terephthalate, polybutylene-terephthalate, polypentylene-terephthalate, polyhexalene-terephthalate, polyheptadene-terephthalate, polyoctalene-terephthalate. Sulfonated polyesters, such as sodio sulfonated polyesters may also be used. Additional resins, such as polyester resins, are as indicated herein, and more specifically, examples further include copoly(1,2-propylene-dipropylene-5-sulfoisophthalate)-copoly(1,2-propylen-e-dipropylene terephthalate), copoly(1,2-propylene-diethylene-5-sulfoisophthalate)-copoly(1,2-propylene-diethylene terephthalate), copoly(propylene-5-sulfoisophthalate)-copoly(1,2-propylene terephthalate), copoly(1,3-butylene-5-sulfoisophthalate)-copoly(1,3-butylene terephthalate), copoly(butylenesulfoisophthalate)-copoly(1,3-butylene terephthalate), combinations thereof and the like.

The polyester resin may be synthesized to have high acid numbers, for example high carboxylic acid numbers, for example, from about 13 mg/eq. KOH to about 40 mg/eq. KOH, or from about 20 mg/eq. KOH to about 35 mg/eq. KOH, such as from about 20 mg/eq. KOH to about 25 mg/eq. KOH. The polyester resin is made to have a high acid number, for example, from about 13 mg/eq. KOH to about 40 mg/eq. KOH, or from about 20 mg/eq. KOH to about 35 mg/eq. KOH, such as from about 20 mg/eq. KOH to about 25 mg/eq. KOH, by using an excess amount of diacid monomer over the diol monomer, or by using acid anhydrides to convert the hydroxyl ends to acidic ends, for example, by reaction of the polyester with known organic anhydrides, such as, trimellitic anhydride, phthalic anhydride, dodecyl succinic anhydride, maleic anhydride, 1,2,4,5-benzenedianhydride, 5-(2,5-dioxotetrahydrol)-3-methyl-3-cyclohexene-1,2-dicarboxylic anhydride, 5-(2,5-dioxotetrahydrol)-4-methyl-3-cyclohexen-1,2-dicarboxylic anhydride, pyromellitic dianhydride, benzophenone dianhydride, biphenyl dianhydride, bicyclo [2.2.2]-oct-7-ene tetracarboxylic acid dianhydride, cis,cis,cis,cis, 1,2,3,4-cyclopentane tetracarboxylic acid dianhydride, ethylenediamine tetracetic acid dianhydride, 4,4'-oxydiphthalic anhydride, 3,3',4,4'-diphenylsulfone tetracarboxylic dianhydride, ethylene glycol bis-(anhydro-trimellitate), propylene glycol bis-(anhydro-trimellitate), diethylene glycol bis-(anhydro-trimellitate), dipropylene glycol bis-(anhydro-trimellitate), triethylene glycol bis-(anhydro-trimellitate), tripropylene glycol bis-(anhydro-trimellitate), tetraethylene glycol bis-(anhydro-trimellitate), glycerol bis-(anhydro-trimellitate), and mixtures thereof. Alternatively, the hydroxyl terminated polyester resin may be converted to high acid number polyester reins, for example, from about 13 mg/eq. KOH to about 40 mg/eq. KOH, or from about 20 mg/eq. KOH to about 35 mg/eq. KOH, such as from about 20 mg/eq. KOH to about 25 mg/eq. KOH, by reacting with multivalent polyacids, such as, 1,2,4-benzene-tricarboxylic acid, 1,2,4 cyclohexanetricarboxylic acid, 2,5,7-naphthalenetricarboxylic acid, 1,2,4 naphthalenetricarboxylic acid, 1,2,5-hexanetricarboxylic acid, 1,3-dicarboxyl-2-methyl-2-methylene-carboxylpropane, tetra(methylene-carboxyl)methane, and 1,2,7,8-octanetetracarboxylic acid, acid anhydrides of multivalent polyacids, and lower alkyl esters of multivalent polyacids; multivalent polyols, such as sorbitol, 1,2,3,6-hexanetetrol, 1,4-sorbitane, pentaerythritol, dipentaerythritol, tripentaerythritol, sucrose, 1,2,4-butanetriol, 1,2,5-pentatriol, glycerol, 2 methyl-propanetriol, 2-methyl-1,2,4-butanetriol, trimethylolethane, trimethylolpropane, 1,3,5 trihydroxymethylbenzene, mixtures thereof, and the like.

In embodiments, the polyester may be, for example, poly (1,2-propylene-diethylene)terephthalte, polyethylene-terephthalate, polypropylene-terephthalate, polybutylene-terephthalate, polypentylene-terephthalate, polyhexalene-terephthalate, polyheptadene-terephthalate, polyoctalene-terephthalate, polyethylene-sebacate, polypropylene-sebacate, polybutylene-sebacate, polyethylene-adipate, polypropylene-adipate, polybutylene-adipate, polypentylene-adipate, polyhexalene-adipate polyheptadene-adipate, polyoctalene-adipate, polyethylene-glutarate, polypropylene-glutarate, polybutylene-glutarate, polypentylene-glutarate, polyhexalene-glutarate, polyheptadene-glutarate, polyoctalene-glutarate, polyethylene-pimelate, polypropylene-pimelate, polybutylene-pimelate, polypentylene-pimelate, polyhexalene-pimelate, polyheptadene-pimelate, poly (propoxylated bisphenol co-fumarate), poly(ethoxylated bisphenol co-fumarate), poly(butyloxylated bisphenol co-fumarate), poly(co-propoxylated bisphenol co ethoxylated bisphenol co-fumarate), poly(1,2-propylene fumarate), poly (propoxylated bisphenol co-maleate), poly(ethoxylated bisphenol co-maleate), poly(butyloxylated bisphenol co-maleate), poly(co-propoxylated bisphenol co ethoxylated bisphenol co-maleate), poly(1,2-propylene maleate), poly (propoxylated bisphenol co-itaconate), poly(ethoxylated bisphenol co-itaconate), poly(butyloxylated bisphenol co-itaconate), poly(co-propoxylated bisphenol co ethoxylated bisphenol co-itaconate), poly(1,2-propylene itaconate), or mixtures thereof.

In embodiments, the polyester resin and resulting EA polyester toner each has a high acid number.

The toner may include more than one resin, and optionally one of the resins may be a crystalline resin, or a branched resin.

At least one colorant including dyes, pigments, mixtures of dyes, mixtures of pigments, and mixtures of dyes and pigments, of any type may be used. Various known colorants, especially pigments, present in the toner in an effective amount of, for example, from about 1 to about 65, for example from about 2 to about 35 percent by weight of the toner or from about 1 to about 15 weight percent, that may be used include carbon black like REGAL 330™, magnetites such as Mobay magnetites MO8029™, MO8060™, and the like. As colored pigments, there can be selected known cyan, magenta, yellow, red, green, brown, blue or mixtures thereof. Specific examples of colorants, especially pigments, include phthalocyanine HELIOGEN BLUE L6900™, D6840™, D7080™, D7020™, Cyan 15:3, Magenta Red 81:3, Yellow 17, the pigments of U.S. Pat. No. 5,556,727, the disclosure of which is totally incorporated herein by reference, and the like. Examples of specific magentas that may be selected include, for example, 2,9-dimethyl-substituted quinacridone and anthraquinone dye identified in the Color Index as CI 60710, CI Dispersed Red 15, diazo dye identified in the Color Index as CI 26050. CI Solvent Red 19, and the like. Illustrative examples of specific cyans that may be selected include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like. Illustrative specific examples of yellows that may be selected are Diarylide Yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan, magenta, yellow components may also be selected as pigments. The colorants, such as pigments, selected can be flushed pigments as indicated herein. Colorant examples further include Pigment Blue 15:3 having a Color Index Constitution Number of 74160, Magenta Pigment Red 81:3 having a Color Index Constitution Number of 45160:3, and Yellow 17 having a Color Index Constitution Number of 21105, and known dyes such as food dyes, yellow, blue, green, red, magenta dyes, and the like.

Additional useful colorants include pigments in water based dispersions such as those commercially available from, for example, Sun Chemical and include SUNSPERSE BHD 6011X (Blue 15 Type), SUNSPERSE BHD 9312X (Pigment Blue 15 74160), SUNSPERSE BHD 6000X (Pigment Blue 15:3 74160), SUNSPERSE GHD 9600X and GHD 6004X (Pigment Green 7 74260), SUNSPERSE QHD 6040X (Pigment Red 12273915), SUNSPERSE RHD 9668X (Pigment Red 185 12516). SUNSPERSE RHD 9365X and 9504X (Pigment Red 57 15850:1, SUNSPERSE YHD 6005X (Pigment Yellow 83 21108), FLEXIVERSE YFD 4249 (Pigment Yellow 17 21105), SUNSPERSE YHD 6020X and 6045X (Pigment Yellow 74 11741), SUNSPERSE YHD 600X and 9604X (Pigment Yellow 14 21095), FLEXIVERSE LFD 4343 and LFD 9736 (Pigment Black 7 77226), and the like or mixtures thereof. Other useful water based colorant dispersions commercially available from, for example, Clariant include HOSTAFINE, Yellow GR, HOSTAFINE Black T and Black TS, HOSTAFINE Blue B2G, HOSTAFINE Rubine F6B and magenta dry pigment such as Toner Magenta 6BVP2213 and Toner Magenta E02, which can be dispersed in water and/or surfactant prior to use.

When the colorant is added with the polymer binder particles before aggregation, the colorant may be added as a dispersion of the colorant in an appropriate medium that is, a medium compatible or miscible with the latex emulsion including the polymer particles therein. In embodiments, both the polymer binder and the colorant are in an aqueous medium.

The toner composition of embodiments can be prepared by a number of known methods, including melt blending the toner resin particles and colorant followed by mechanical attrition. Other methods include those known in the art such as spray drying, melt dispersion, emulsion aggregation, dispersion polymerization, suspension polymerization, and extrusion. Generally, the toners are prepared to have toner particles with an average volume diameter of from about 4 to about 20 microns.

The toner particles selected may be prepared by emulsion techniques, and the monomers utilized in such processes can be selected from the group consisting of styrene, acrylates, methacrylates, butadiene, isoprene, and optionally acid or basic olefinic monomers such as acrylic acid, methacrylic acid, acrylamide, methacrylamide, quaternary ammonium halide of dialkyl or trialkyl acrylamides or methacrylamide, vinylpyridine, vinylpyrrolidone, vinyl-N-methylpyridinium chloride and the like. The presence of acid or basic groups is optional. Crosslinking agents such as divinylbenzene or dimethacrylate and the like, can also be selected in the preparation of the emulsion. Chain transfer agents, such as dodecanethiol or carbontetrachloride and the like, can also be selected when preparing toner particles by emulsion polymerization.

Monomers, such as vinyl monomers may include styrene, p-chlorostyrene vinyl naphthalene, unsaturated mono-olefins such as ethylene, propylene, butylene and isobutylene; vinyl halides such as vinyl chloride, vinyl bromide, vinyl fluoride, vinyl acetate, vinyl propionate, vinyl benzoate, and vinyl butyrate; vinyl esters like the esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalphachloracrylate, methyl methacrylate, ethyl methacrylate, and butyl methacrylate; acrylonitrile, methacrylonitrile, acrylamide, vinyl ethers, inclusive of vinyl methyl ether, vinyl isobutyl ether, and vinyl ethyl ether; vinyl ketones inclusive of vinyl methyl ketone, vinyl hexyl ketone and methyl isopropenyl ketone; vinylidene halides such as vinylidene chloride and vinylidene chlorofluoride; N-vinyl indole, N-vinyl pyrrolidone; and the like. Also, there may be selected styrene butadiene copolymers, mixtures thereof, and the like.

The resin may comprise various effective amounts, such as from about 25 weight percent to about 98 weight percent, for example about 50 to about 95 weight percent, of the toner. Other effective amounts of resin can be selected.

Various optional additives may also be included in the toner composition. Such additives may include additives relating to the aggregation process, for example, surfactants to assist in the dispersion of the components or coagulants or other aggregating agents used to assist in the formation of the larger size toner particle aggregates. Such additives may also include additives for the toner core particle itself, for example, waxes, charge controlling additives, and the like. Any other additives may also be included in the dispersion for the aggregation phase, as desired or required.

Examples of waxes that can be selected for the processes and toners illustrated herein include polypropylenes and polyethylenes commercially available from, for example, Allied Chemical and Petrolite Corporation, wax emulsions available from, for example, Michaelman Inc. and the Daniels Products Company, EPOLENE N-15™ commercially available from, for example, Eastman Chemical Products, Inc., VISCOL 550-P™, a low weight average molecular weight polypropylene available from, for example, Sanyo Kasei K. K., and similar materials. The commercially available polyethylenes selected possess, it is believed, a molecular weight $M_w$ of from about 500 to about 3,000, while the commercially available polypropylenes are believed to have a molecular weight of from about 4,000 to about 7,000. Examples of functionalized waxes include, such as amines and amides, for example, AQUA SUPERSLIP 6550™, SUPERSLIP 6530™ available from, for example, Micro Powder Inc., fluorinated waxes, such as POLYFLUO 190™, POLYFLUO 200™, POLYFLUO 523XF™, AQUA POLYFLUO 411™, AQUA POLYSILK 19™, POLYSILK 14™ available from, for example, Micro Powder Inc., mixed fluorinated amide waxes, such as MICROSPERSION 19™ available from, for example, Micro Powder Inc., imides, esters, quaternary amines, carboxylic acids or acrylic polymer emulsion, such as JONCRYL 74™, 89™, 130™, 537™, and 538™, are all available from, for example, SC Johnson Wax, chlorinated polypropylenes and polyethylenes available from, for example, Allied Chemical, Petrolite Corporation and SC Johnson Wax.

Illustrative examples of aggregating components or agents include zinc acetate; alkali earth metal or transition metal salts; alkali (II) salts, such as beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, barium iodide, and the like. Examples of transition metal salts or anions include acetates, acetoacetates, sulfates of vanadium, niobium, tantalum, chromium, molybdenum, tungsten, manganese, iron, ruthenium, cobalt, nickel, copper, zinc, cadmium, silver or aluminum salts, such as aluminum acetate, polyaluminum chloride, aluminum halides, mixtures thereof, and the like. If present, the amount of aggregating agent selected can vary, and is, for example, from about 0.1 to about 10, and more specifically from about 1 to about 5 weight percent by weight of toner or by weight of water.

The toner includes one or more surface additives thereon. Examples of surface additives include, for example, silica, titania, alumina, stearates such as calcium or zinc, cerium oxide, UADD and long chain alcohols, and the like. Specific examples include surface treated fumed silicas, for example, TS-530 silica from Cabosil Corporation, with an 8 nanometer particle size and a surface treatment of hexamethyldisilazane (HMDS); NAX50, RX50, silica with a 40 nm particle size and R812 with 7 nm particle size obtained from DeGussa/Nippon Aerosil Corporation; RY50, NY50 silica of 40 nm size and RY200 12 nm treated with PDMS, polydimethylsiloxane; H2050EP silica coated with an amino functionalized organopolysiloxane obtained from Wacker Chemie; metal oxides such as $TiO_2$, for example MT-3103 from Tayca Corp. with a 16 nanometer particle size and a surface treatment of decylsilane; SMT5103, obtained from Tayca Corporation, comprised of a crystalline titanium dioxide core MT500B coated with DTMS; P-25 from Degussa Chemicals of 21 nm particle size with no surface treatment; A300 silica from Degussa with 8 nm particle size with no surface treatment, alternate metal oxides such as aluminum oxide or Aluminum Oxide C from Degussa with 13 nm size and no surface treatment, and as a lubricating agent, for example, stearates or long chain alcohols, such as UNILIN 700™, and the like. In general, silica is applied to the toner surface for toner flow, tribo enhancement, admix control, improved development and transfer stability, and higher toner blocking temperature. $TiO_2$ is applied for improved RH stability, tribo control and improved development and transfer stability.

Other potential surface toner additives include polystyrene, calcium carbonate, polycarbonate, PMMA, polycarbonate, alumina, nylon 6,6, PET, R812, PTFE, PVC, carbon fiber and cellulose.

Metal oxide external surface additives are common in toners. One function of these oxides is to possibly contribute to the control of toner charging. In turn, the charge provided by the oxide is controlled by the oxide work function. Common external surface additives include, for example, silica and titania.

Effective attachment of the surface additives to the toner particles is desired to avoid additives falling off of the toner in use. As mentioned above, embedding, impaction, increased blend time or blend power, or reducing the size of the surface additives, has a negative effect on print quality and cost. Thus, the ultimate goal is to provide sufficient attachment of external additives with toner particles without these drawbacks. Two materials brought into intimate contact may interact through, for example, dispersion (or Van der Waals) forces, which are relatively weak; polar interactions, which are stronger but are present only in polar materials; electrostatic Forces, which are potentially strong. However, for a negative toner charge, both the resin binder and the surface additive are generally negatively charged for effective negative charge, or for a positive charge toner both the resin binder and the additive are generally positively charged for effective negative charge. As such, the electrostatic force will be ineffective, only if the toner resin and additive are of opposite polarity will there be an effective electrostatic adhesion of the additive to the resin, in which case it may be difficult to obtain sufficient toner charge required and/or acid-base interactions, which are strong. As will be shown below in detail, use of proper acid-base interactions of both a toner and an additive increases the adhesion between the toner and the additive, thus increasing the adhesive force that holds the additive onto the surface of the toner.

In embodiments, both the toner and additives will have both Lewis acid and Lewis base properties, denoted as $(K_a)_{toner}$ and $(K_b)_{toner}$ for the toner, and $(K_a)_{additive}$ and $(K_b)_{additive}$ for the additive, respectively. The $K_a$ and $K_b$ values may be determined by Inverse Gas Chromatography (IGC) measurement of the toner surface and of the additive surface using established techniques. In further embodiments, more than one binder may be used and thus the $K_a$ and $K_b$ for the binder(s) can be readily obtained and thereafter be applied in the IGC method. IGC is a powerful method to study the adhesive force that holds the additive on to the surface of the toner. These parameters represent the ability of materials to accept or donate electrons, respectively. The acid-base interactions between the toner and the additive may be characterized by an Interaction Surface Parameter ($I_{SP}$). Thus, the acid-base interaction parameter between the toner and the additive surface can be calculated by the following equation:

$$\text{Interaction Surface Parameter}=(I_{SP})_{toner,additive}=[(K_a)_{toner}\times(K_b)_{additive}]+[(K_b)_{toner}\times(K_a)_{additive}]-[(K_a)_{toner}\times(K_a)_{additive}]-[(K_b)_{toner}\times(K_b)_{additive}]$$

In embodiments, this relationship demonstrates that to maximize the acid-base pair interaction between the toner and the additive, there will be a net acid-base interaction between them that will produce an adhesive force that will hold the additive on the toner surface where $(I_{SP})_{toner,additive}>0$, for example, >2. In the alternative, where $(I_{SP})_{toner,additive}\leqq 0$, there will be no acid-base interaction, and therefore no acid-base net adhesive force, resulting in a much weaker attachment of the additive. Thus, by proper selection of toner materials and surface additives with suitable interaction parameters based on the acid-base properties of the materials, it is possible to attach additives more strongly.

As mentioned above, it is not desirable to have small additive particles. In embodiments, the additive particles are large, for example, from about 30 nm to about 150 nm, such as about 50 nm to about 150 nm, or from about 100 nm to about 150 nm.

For a given toner binder, a selection of potential surface additives that contain various potential properties can be achieved by calculating $(I_{SP})_{toner,additive}$ for a toner/additive pair. Thus, when $(I_{SP})_{toner,additive}>0$, for example, >2, the surface additive includes the desired acid-base pair interaction with the toner and therefore the surface additive is selected. A second surface additive that contains a further desired property may also be selected by calculating $(I_{SP})_{toner,additive}$, and thus, if this surface additive yields an $(I_{SP})_{toner,additive}>0$, for example, >2, this surface additive may also be included with the toner.

As mentioned above, when $(I_{SP})_{toner,additive}>0$, for example, >2, the surface additive includes the desired acid-base pair interaction with the toner and therefore the surface additive may be selected. Thus, the selected surface additive may be blended with the toner to achieve a toner having the additive on an external surface thereof and in which the toner and additive exhibit a sufficient adhesive force to hold the additive on the toner surface.

Example 1

Below, Table 1 illustrates the aced-base interaction parameter calculated for various possible surface additives for a polystyrene particle that is representative of a toner particle material. The table reports the acid and base values, the calculated $I_{SP}$ with polystyrene, and also includes whether adhesion would be achieved with the acid-base properties for the polystyrene and surface additive pair. H2050 and R812 silica are well known silica surface additives for toner.

TABLE 1

| Material | $K_a$ | $K_b$ | $K_a/K_b$ | $I_{SP\ (Polystyrene\ toner)}$ | Acid-Base Adhesion |
|---|---|---|---|---|---|
| Polystyrene | 0.4 | 2.6 | 0.15 | −4.8 | No |
| Calcium carbonate | 1.5 | 5.9 | 0.25 | −9.7 | No |
| Polycarbonate | 2.9 | 5.8 | 0.50 | −6.4 | No |
| PMMA (XRCC) | 1.1 | 3.0 | 0.37 | −4.2 | No |
| Polycarbonate | 2.0 | 3.8 | 0.53 | −4.0 | No |
| Alumina | 1.4 | 2.8 | 0.50 | −3.1 | No |
| Silica (H2050) | 0.8 | 1.4 | 0.55 | −1.4 | No |
| Nylon 6,6 | 0.8 | 1.4 | 0.57 | −1.3 | No |
| titania (P25) | 2.6 | 3.1 | 0.84 | −1.1 | No |
| PET | 1.7 | 1.9 | 0.89 | −0.4 | No |
| R812 | 1.7 | 0.8 | 2.14 | 2.0 | Yes |
| Silica (A300) | 3.0 | 1.8 | 1.67 | 2.6 | Yes |
| PTFE | 1.8 | 0.6 | 3.00 | 2.6 | Yes |
| PVC | 6.3 | 1.8 | 3.50 | 9.9 | Yes |
| Carbon Fiber | 6.5 | 1.5 | 4.33 | 11.0 | Yes |
| PVC | 8.5 | 2.1 | 4.05 | 14.1 | Yes |
| Cellulose | 16.1 | 9.2 | 1.75 | 15.2 | Yes |

As shown in Table 1, there are several surface additives that do not provide good acid-base adhesion with polystyrene. While these additives may not be a good fit for polystyrene, this does not mean that these additives would not be well suited for other toners. Thus, if a particular additive is needed, a suitable binder resin must be chosen that allows for a positive $I_{SP}$. A decision on which binder resin and additives will be used is a balance of which is more important. For example, if a particular binder resin is essential, one must work with the particular additives that provide the needed positive $I_{SP}$ value. On the other hand, a certain additive may provide a necessary characteristic such as a flow property, that other additives cannot, and thus a suitable binder resin may be selected based on the needed additive. The detailed chemistry of the resin and the additives is very important to the selection of the additive and the resin, as shown in Table 1 the same polymer type, PVC, can provide different $K_a$ and $K_b$ values, and thus different adhesion to the toner resin, depending on the particular details of its preparation.

Example 2

An emulsion/aggregation toner may be prepared according to the following procedure:

Latex Preparation

A solution is prepared by mixing together an aqueous solution of 6 grams of ammonium persulfate in 200 milliliters of water, 700 milliliters of an aqueous solution of 13.5 grams of anionic surfactant, NEOGEN™ (which is comprised of 60 weight percent of sodium dodecyl benzene sulfonate in water, and 12.9 grams of ANTAROX 897™ (which is comprised of 70 weight percent of polyoxyethylene nonyl phenyl ether in water). A mixture of 492 grams of styrene, 108 grams of butyl acrylate, 12 grams of acrylic acid, 18 grams of dodecanethiol, and 6 grams of carbon tetrabromide is added to the above prepared aqueous solution. The resulting mixture is then homogenized for 30 minutes at room temperature, at 25° C., in a nitrogen atmosphere. Subsequently, the mixture is heated at a rate of 1° C. per minute to reach a temperature of 70° C., where the temperature is then maintained for 6 hours. The resulting polymer latex provides a measured weight average molecular weight of 28,560, a number average molecular weight of 6580, and a Tg onset glass transition temperature of 59° C.

Toner Preparation

To prepare toner, 1040 grams of the latex emulsion that was prepared above and 880 grams of aqueous cyan pigment dispersion, which consisted of 16 grams of Pigment and 15.3 and 10.4 grams of SANIZOL B™ cationic surfactant, are added together into 400 milliliters of water with a high shear stirring using a polytron. The mixture is transferred to a 10 liter 2 liter reaction vessel and heated at a temperature of 50° C. for 1 hour. Next, 180 milliliters of 20 percent aqueous NEOGEN $R_X$.™ solution is added. Subsequently, the mixture are heated to 95° and maintained at 95° C. for a period of 6 hours. The mixture is then cooled down to room temperature. The pH of the mixture is adjusted to 8.5 with a 3.5 weight percent potassium hydroxide solution and then stirred for 1 hour and filtered. The filter cake is redispersed in 4 liters of water with the aid of a mechanical stirrer and the resulting toner slurry is brought to a pH of 8.5 with 4 weight percent (w/w of water) dilute aqueous KOH solution, stirred for 60 minutes, and filtered. The filter cake is again redispersed in 4 liters of water and the resulting toner slurry is brought to pH of 8.5 with 4 weight percent dilute aqueous KOH solution, stirred for 60 minutes, and filtered. The washing is repeated twice in the same manner with water only. The toner is dried on a freeze drier. The final toner particle size is about 6.4 microns in volume average diameter, with a lower particle size distribution of about 1.21 and an upper particle size distribution of 1.27 as measured with a Coulter Counter.

As show in table 2 (below), for the EA toner, many additives do not provide a good adhesion to the toner from the $I_{SP}$ value, while some others provide some adhesion (>0), and a few a strong adhesion ($I_{SP}$>2).

TABLE 2

| Material | $K_a$ | $K_b$ | $K_a/K_b$ | $I_{SP\ (EA\ toner)}$ | Acid-Base Adhesion |
|---|---|---|---|---|---|
| EA Toner Example 2 | 0.8 | 1.6 | 0.51 | −0.6 | No |
| Calcium carbonate | 1.5 | 5.9 | 0.25 | −3.5 | No |
| Polycarbonate | 2.9 | 5.8 | 0.50 | −2.3 | No |
| Polystyrene | 0.4 | 2.6 | 0.15 | −1.7 | No |
| PMMA (XRCC) | 1.1 | 3.0 | 0.37 | −1.5 | No |
| Polycarbonate | 2.0 | 3.8 | 0.53 | −1.4 | No |
| Alumina | 1.4 | 2.8 | 0.50 | −1.1 | No |
| Silica (H2050) | 0.8 | 1.4 | 0.55 | −0.5 | No |
| Nylon 6,6 | 0.8 | 1.4 | 0.57 | −0.5 | No |
| titania (P25) | 2.6 | 3.1 | 0.84 | −0.4 | No |
| PET | 1.7 | 1.9 | 0.89 | −0.2 | No |
| R812 | 1.7 | 0.8 | 2.14 | 0.7 | Yes |
| Silica (A300) | 3.0 | 1.8 | 1.67 | 0.9 | Yes |
| PTFE | 1.8 | 0.6 | 3.00 | 0.9 | Yes |
| PVC | 6.3 | 1.8 | 3.50 | 3.6 | Yes |
| Carbon Fiber | 6.5 | 1.5 | 4.33 | 4.0 | Yes |
| PVC | 8.5 | 2.1 | 4.05 | 5.1 | Yes |
| Cellulose | 16.1 | 9.2 | 1.75 | 5.5 | Yes |

Thus, in selecting surface additives, select from where $I_{SP}$>0 to complete toner.

It will be appreciated that various of the above-disclosed and other features and functions, or alternatives thereof, may be desirably combined into many other different systems or applications. Also, it will be appreciated that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A developer comprised of a toner and at least one external surface additive, wherein an acid-base interaction has an Interaction Surface Parameter ($I_{SP}$) of greater than 0, and wherein $I_{sp}$ is defined by the following equation:

$$[(K_a)_{toner}\times(K_b)_{additive}]+[(K_b)_{toner}\times(K_a)_{additive}]-[(K_a)_{toner}\times(K_a)_{additive}]-[(K_b)_{toner}\times(K_b)_{additive}];$$

wherein $K_a$ is the Lewis acid value and $K_b$ is the Lewis base value, wherein the acid-base interaction at least increases the adhesion between the toner and the at least one external surface additive, and wherein the at least one external surface additive has an average size of about 30 nm to about 150 nm.

2. The developer of claim 1, wherein the $I_{SP}$ is greater than about 2.

3. The developer of claim 1, wherein the at least one external surface additive has an average size of about 50 nm to about 150 nm.

4. The developer of claim 1, wherein the at least one external surface additive has an average size of about 100 nm to about 150 nm.

5. The developer of claim 1, wherein the toner is an emulsion aggregation (EA) toner.

6. The developer of claim 1, further comprising a carrier.

7. The developer of claim 1, wherein the toner is comprised of at least one binder resin and at least one colorant.

8. The developer of claim 7, wherein the binder resin is selected from the group consisting of polyacrylates, polyesters, and copolymers of polystyrene or polybutyl acrylates.

9. A method of obtaining acceptable acid-base interaction between a toner and at least one external surface additive of the toner comprising:

selecting a candidate toner;

selecting a candidate external surface additive;

determining the Lewis acid and Lewis base constants for the candidate toner and the candidate external surface additive;

calculating an Interaction Surface Parameter ($I_{SP}$); and wherein the acid-base interaction at least increases the adhesion between the toner and the at least one external surface additive;

wherein the at least one external surface additive has an average size of about 30 nm to about 150 nm;

wherein the Interaction Surface Parameter ($I_{SP}$) of greater than 0 is predictive of acceptable acid-base interaction; and wherein $I_{SP}$ is defined by the following equation:

$$[(K_a)_{toner}\times(K_b)_{additive}]+[(K_b)_{toner}\times(K_a)_{additive}]-[(K_a)_{toner}\times(K_a)_{additive}]-[(K_b)_{toner}\times(K_b)_{additive}].$$

10. The method of claim 9, wherein the $I_{SP}$ is greater than about 2.

11. The method of claim 9, wherein the external surface additive has an average size of about 50 nm to about 150 nm.

12. The method of claim 9, wherein the external surface additive has an average size of about 100 nm to about 150 nm.

13. The method of claim 9, wherein the toner is generated by an emulsion aggregation process.

14. A method of making a developer composed of at least a toner and at least one external surface additive comprising:

determining a Lewis acid constant for the toner, a Lewis base constant for the toner, a Lewis acid constant for the at least one external surface additive, and a Lewis base constant for the at least one external surface additive;

calculating the Interaction Surface Parameter ($I_{SP}$) by applying the following equation:

$$[(K_a)_{toner}\times(K_b)_{additive}]+[(K_b)_{toner}\times(K_a)_{additive}]-[(K_a)_{toner}\times(K_a)_{additive}]-[(K_b)_{toner}\times(K_b)_{additive}];$$

and when the $I_{SP}$ is greater than 0, combining the toner and the at least one external surface additive, wherein the acid-base interaction at least increases the adhesion between the toner and the at least one external surface additive; and wherein the at least one external surface additive has an average size of about 30 nm to about 150 nm.

15. The method of claim 14, wherein the combining is conducted when the $I_{sp}$ is greater than about 2.

16. The method of claim 14, wherein the at least one external surface additive has an average size of about 50 nm to about 150 nm.

17. The method of claim 14, wherein the at least one external surface additive has an average size of about 100 nm to about 150 nm.

18. The method of claim 14, wherein the toner is generated by an emulsion aggregation process.

19. The method of claim 14, wherein the developer further comprises a carrier.

20. The method of claim 14, wherein the developer includes more than one surface additive and wherein each surface additive has an $I_{SP}$ of greater than 0 with the toner.

21. The method of claim 20, wherein the $I_{SP}$ of the toner and surface additives is greater than 2.

* * * * *